US008938895B2

(12) United States Patent
Pippins

(10) Patent No.: US 8,938,895 B2
(45) Date of Patent: Jan. 27, 2015

(54) TOOTH ASSEMBLY FOR EXCAVATING APPARATUS WITH RARE EARTH MATERIAL

(71) Applicant: Trinity Industries, Inc., Dallas, TX (US)

(72) Inventor: Sherlock K. Pippins, Dallas, TX (US)

(73) Assignee: Trinity Industries, Inc., Dallas, TX (US)

( * ) Notice: Subject to any disclaimer, the term of this patent is extended or adjusted under 35 U.S.C. 154(b) by 0 days.

(21) Appl. No.: 13/656,203

(22) Filed: Oct. 19, 2012

(65) Prior Publication Data

US 2013/0097894 A1 Apr. 25, 2013

Related U.S. Application Data

(60) Provisional application No. 61/549,509, filed on Oct. 20, 2011.

(51) Int. Cl.
*E02F 9/28* (2006.01)

(52) U.S. Cl.
CPC ..... *E02F 9/2825* (2013.01); *E02F 9/2841* (2013.01); *E02F 9/2891* (2013.01)
USPC ..... 37/455

(58) Field of Classification Search
USPC ..... 37/446–460; 335/296, 297, 298, 302, 335/303, 304, 305; 292/251.5, 303
See application file for complete search history.

(56) References Cited

U.S. PATENT DOCUMENTS

| | | | | |
|---|---|---|---|---|
| 2,627,423 | A * | 2/1953 | Copeman | 280/515 |
| 3,256,043 | A * | 6/1966 | Krekeler | 299/108 |
| 3,302,566 | A * | 2/1967 | Blanchet | 101/405 |
| 3,899,762 | A * | 8/1975 | Studders | 335/302 |
| 5,337,495 | A | 8/1994 | Pippins | |
| 5,400,479 | A * | 3/1995 | Medina et al. | 24/303 |
| 5,473,799 | A * | 12/1995 | Aoki | 24/303 |
| 6,502,336 | B2 | 1/2003 | Pippins | |
| 7,032,334 | B2 | 4/2006 | Pippins | |
| 7,676,968 | B2 * | 3/2010 | Hall et al. | 37/460 |
| 2003/0037468 | A1 * | 2/2003 | Adamic et al. | 37/455 |
| 2007/0175381 | A1 * | 8/2007 | Harder et al. | 116/208 |
| 2009/0044435 | A1 * | 2/2009 | Bentley | 37/456 |
| 2011/0030248 | A1 * | 2/2011 | Clendenning et al. | 37/456 |

FOREIGN PATENT DOCUMENTS

| | | | |
|---|---|---|---|
| EP | 2241683 | A1 | 10/2010 |
| FR | 1425935 | A1 | 10/1965 |
| WO | 2004/007852 | A1 | 1/2004 |

OTHER PUBLICATIONS

The International Bureau of WIPO, International Preliminary Report on Patentability for International Application No. PCT/US2012/061052, issued Apr. 22, 2014.

International Search Report and Written Opinion; Application No. PCT/US2012/061052; pp. 22.

* cited by examiner

*Primary Examiner* — Matthew D Troutman
(74) *Attorney, Agent, or Firm* — Baker Botts L.L.P.

(57) ABSTRACT

A system for coupling equipment components includes a magnetic coupling assembly. The magnetic coupling assembly couples a tooth point to an adapter. The magnetic coupling assembly is received at least partially within a recess formed in the adapter. The magnetic coupling assembly includes an insert and a magnetic coupler. The insert is placed within the recess of the adapter, and the insert includes an internal recess. The magnetic coupler is received within the internal recess of the insert.

16 Claims, 8 Drawing Sheets

TOOTH ASSEMBLY FOR EXCAVATING APPARATUS WITH RARE EARTH MATERIAL

RELATED APPLICATION

This application claims the benefit of U.S. Provisional Application Ser. No. 61/549,509, filed Oct. 20, 2011, the disclosure of which is incorporated herein by reference.

TECHNICAL FIELD OF THE INVENTION

This invention relates generally to replaceable machine parts that are exposed to high wear, and more specifically to a tooth assembly for an excavating apparatus with rare earth material.

BACKGROUND OF THE INVENTION

Digging and leveling apparatuses such as draglines, backhoes, front-end loaders, and the like often use replaceable tooth assemblies that are mounted on tooth horns, excavator lips, edges, or the like to provide sacrificial parts that are exposed to repeated shock loading and high wear occasioned by a digging operation. In such systems, each tooth assembly typically includes a wedge-shaped adapter that mounts directly on the tooth horn of the bucket, shovel, or alternative digging or scraping mechanism of the equipment. A wedge-shaped tooth point for engaging the material to be excavated is frontally seated on and securely pinned to the adapter.

Attachment of the tooth point is typically accomplished by means of one or more inserts that are inserted into insert cavities in the adapter. The inserts are internally threaded to accommodate a bolt that secures the tooth point to the adapter. Installation and removal of tooth points secured using such a system requires substantial time and effort because the bolts that secure the tooth points must be screwed in and unscrewed when the tooth is to be replaced. Such screwing and unscrewing operations typically require the use of a powered impact wrench. Moreover, the use of such a tool presents the danger of over-torquing, which results in damage to the threads and possible personal injury to the operator.

SUMMARY OF THE INVENTION

In accordance with particular configurations of the present disclosure, the disadvantages and problems associated with tooth assemblies for excavating apparatuses may be substantially reduced or eliminated.

In accordance with particular configurations of the present disclosure, a system for coupling equipment components may include a magnetic coupling assembly. The magnetic coupling assembly may couple a tooth point to an adapter. The magnetic coupling assembly may be received at least partially within a recess formed in the adapter. The magnetic coupling assembly may include an insert and a magnetic coupler. The insert may be placed within the recess of the adapter, and the insert may include an internal recess. The magnetic coupler may be received within the internal recess of the insert.

Technical advantages provided by particular configurations of the present disclosure may include allowing operators of excavation equipment or other replaceable machine parts to quickly and efficiently install and remove replaceable parts. For example, a tooth point may be coupled to or removed from an adapter using a magnetic coupler. The magnetic coupler may be removed quickly and efficiently utilizing one or more of a mechanical replacement tool and a heating element as the tooth point degrades or wears out during use. By substantially reducing replacement time of replaceable parts, such a magnetic coupler may allow operators to utilize excavating equipment and other machine parts longer and with less idle time.

DETAILED DESCRIPTION OF THE INVENTION

An attachment system in accordance with particular configurations of the present disclosure is described herein with particular reference to the attachment and removal of replaceable teeth to and from excavating equipment, such as dragline buckets, and more particularly to the attachment and removal of replaceable teeth to and from the assemblies disclosed in U.S. Pat. Nos. 5,337,495, 6,502,336, and 7,032,334, the disclosures of which are incorporated herein by reference. Those skilled in the art will understand, however, that configurations of the present disclosure may be applicable to other machines using replaceable parts. Examples of such machines may include downhole drills and related tools, conveyor belt parts, center wear shrouds and wing shrouds on dragline buckets, track shoes for tracked vehicles, machine gun and artillery breech parts, cutting edges, pins, protectors, ripper components, and the like.

Figure 1:
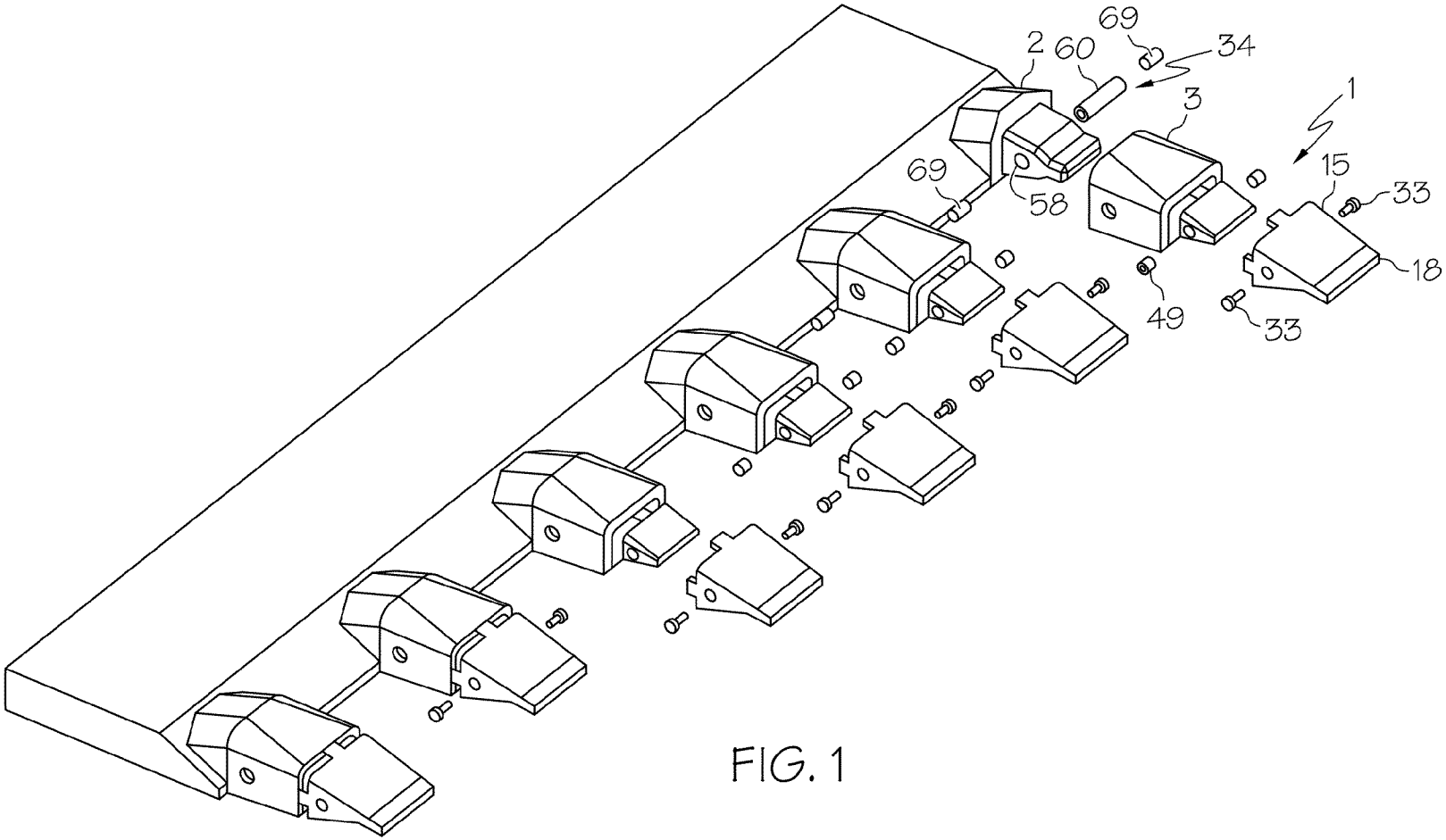
FIG. 1 shows a perspective view of an attachment system in accordance with particular configurations of the present disclosure.

Referring to the drawings and to FIG. 1 in particular, the tooth assembly of this invention is generally illustrated by reference numeral 1 and may be mounted on a conventional tooth horn 2 of the bucket or shovel of a conventional excavator. The tooth assembly 1 may include a wedge-shaped adapter 3 fitted with a removable tooth point 15, which may have a contact edge 18 and may be mounted on the adapter 3 by means of one or more (e.g., a pair of) tooth point retainer pins 33. Each of tooth point retainer pins 33 may extend through a tooth point retainer pin opening in a tooth point side wall of the removable tooth point 15 and may thread into one or more (e.g., a pair of) inserts 49, which may be seated on sides of (e.g., opposing sides of) the adapter 3. In certain configurations, the tooth assembly 1 may include a transversely-mounted top wear cap and bottom wear cap, each of which may be bolted to the adapter 3 by means of side plate bolts. In some configurations, the adapter 3 may include a wedge-shaped adapter base that may taper from a base plate to a nose ridge of the adapter 3 and may terminate at a nose of the adapter 3. A base plate lock opening for receiving a spool and a companion wedge and for mounting the adapter 3 on the tooth horn 2 may be provided in a base plate of the adapter base. A pair of transverse, vertically-oriented, spaced stabilizing slots may be provided in the sides of the adapter base. Spaced, parallel top rib slots may be provided transversely in the top tapered face of the base plate of the adapter base, and, in certain configurations, the top rib slots may be T-shaped. Similarly, a pair of spaced, T-shaped bottom rib slots may be provided in one or more of a bottom tapered surface and a face of the base plate of the adapter base along the same relative position as the top rib slots. The top rib slots and bottom rib slots may alternatively be shaped in one or more of a "dovetail" and alternative locking configuration, according to the knowledge of those skilled in the art.

Adapter 3 may be coupled to tooth horn 2 using pin assembly 34. During excavation and/or mining operations, adapter 3 may be subject to significant wear and tear. Extreme shock loading may be experienced as removable adapter 3 impacts adjacent earth, rocks, and other abrasive material. Therefore, it may be desirable to make adapter body 3 readily replaceable with a new or reconditioned component of similar or identical configuration. Otherwise, one or more of tooth horn 2, buckets, shovels, and other excavation equipment would need to be replaced more frequently, which may increase equipment and labor costs associated therewith. By providing a removable adapter 3 at the location of tooth horn 2, which may otherwise experience substantial wear, the service life of such equipment may be prolonged by replacing selected parts associated with the excavation equipment.

In order to prevent excessive wear of tooth horn 2, for example, adapter 3 may be coupled with tooth horn 2. Consequently, adapter 3 may at least partially conceal and/or protect tooth horn 2 from abrasive materials during excavation. Tooth horn 2 may be configured to be received in an opening in adapter 3. When adapter 3 and tooth horn 2 are coupled, first and second sides of tooth horn 2 may be disposed adjacent to first and second sides of adapter 3.

The configuration of adapter 3 and tooth horn 2 may vary significantly within the teachings of the present invention. For example, although adapter 3 is described above as having first and second tapered surfaces, in other configurations, adapter 3 may include only one tapered side. Alternatively, adapter 3 may not have any tapered sides. Furthermore, although adapter 3 is described above as having first and second sides that are generally parallel to one another, in other configurations, one or both of first and second sides may be tapered, such that the first and second sides may not be parallel to one another. Similar alterations may be made to tooth horn 2 within the teachings of the present disclosure. In general, the configurations of the excavation components may be selected to receive and provide protection from excessive wear caused during excavation operations.

Tooth horn 2 may include a pin bore 58 that may originate at a first side of tooth horn 2 and extend at least partially through tooth horn 2. In FIG. 1, pin bore 58 extends through tooth horn 2 from a first side to a second side. Pin bore 58 may be configured to at least partially receive pin assembly 34 therein. Pin bore 58 and pin assembly 34 may cooperate to provide for one or more of simplified installation and removal of adapter 3 from tooth horn 2. Accordingly, adapter 3 may be installed, removed, or replaced by an operator in the field, quickly and easily. Additionally, the configuration of pin bore 58 and pin assembly 34 may prevent shifting of a tool body with respect to tooth horn 2 during use thereof.

In certain configurations, pin assembly 34 may include an elongate insert 60 and a plug 69. Insert 60 may be configured to be at least partially received within pin bore 58. Accordingly, the shape and size of pin bore 58 may correspond to the shape and size of insert 60. The configurations of pin bore 58 and insert 60 may vary significantly within the teachings of the present invention. In particular configurations, insert 60 may be of a geometric shape that may include a number of sides of equal width. Because the shape of pin bore 58 may correspond to the shape of insert 60, pin bore 58 may be of a geometric shape that may include a number of sides of equal width. In particular configurations, insert 60 and pin bore 58 may each be of a shape having between three and eight sides. Nevertheless, insert 60 and pin bore 58 may be of any suitable geometric shape. Pin assembly 34 may include one or more plugs 69, which may be configured to cooperate with a plug bore in insert 60. The plug bore may extend at least partially through insert 60 and may be configured to at least partially receive one or more plugs 69 therein. In FIG. 1, the plug bore extends entirely through insert 60 from a first end to a second end. Accordingly, the plug bore may be configured to receive a first plug at first end and a second plug at a second end. It is recognized, however, that the plug bore may not extend entirely through insert 60. When the plug bore does not extend entirely through insert 60, a single plug 69 may be used.

In operation, plugs 69 and insert 60 may cooperate to couple adapter 3 to tooth horn 2 in an installed configuration. The sides of tooth horn 2 may include respective openings, which may be configured to receive a portion of one or more plugs 69 at least partially therethrough. The respective positions of the openings upon the sides of adapter 3 may be selected to align with the first and second ends of pin bore 58, respectively. When adapter 3 is properly positioned upon tooth horn 2, pin bore 58 and the openings may be aligned such that one or more of an imaginary central axis, an approximately-central axis, and one or more other longitudinal axes may extend through the openings of adapter 3 and insert 60. In the installed position, a plug 69 may be inserted through each opening of adapter 3 and into at least a portion of pin bore 58 to couple adapter 3 to tooth horn 2. In the correct installed position, plugs 69 may be recessed from the sides of adapter 3 by approximately 0.125 to 1.000 inches. In particular configurations, plugs 69 may be recessed from the sides of adapter 3 by 0.25 to 0.5 inches.

Figure 2A:
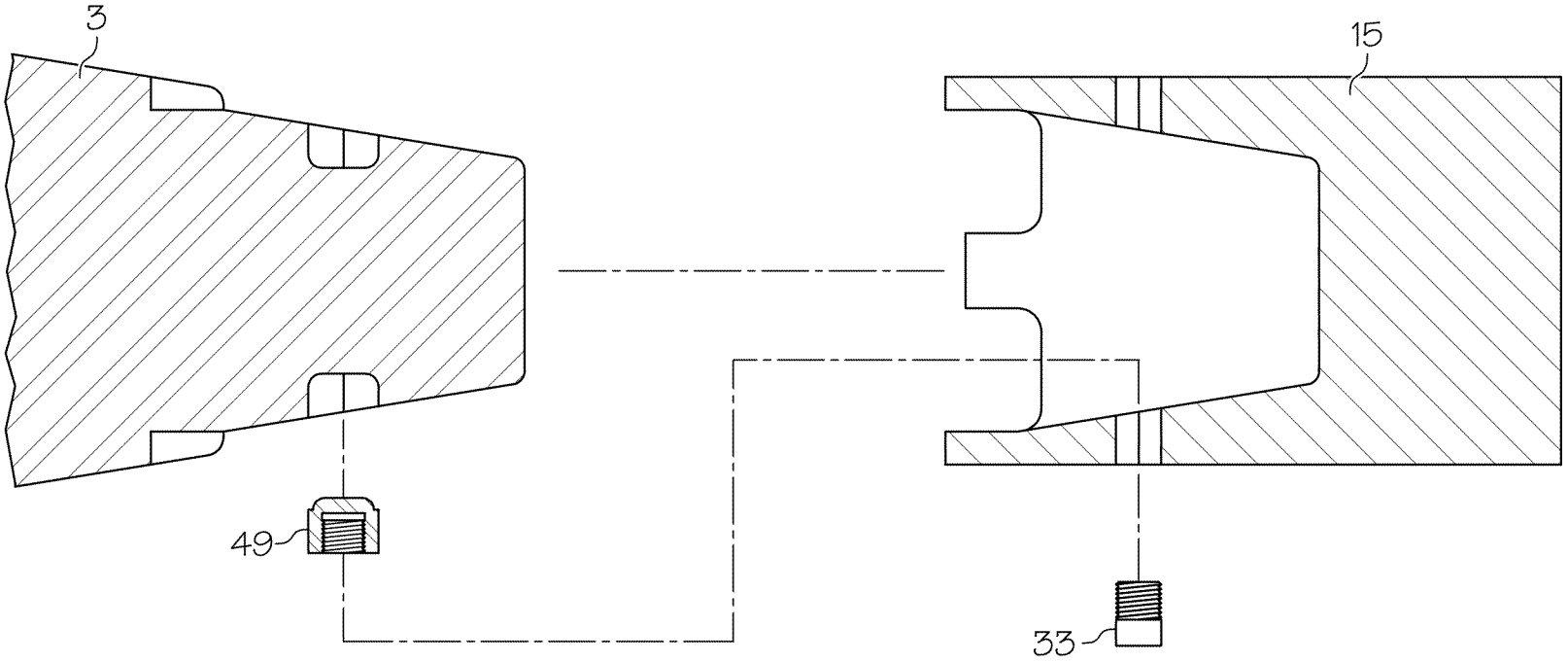
FIG. 2A shows an exploded top sectional view of a tooth assembly of an attachment system in accordance with particular configurations of the present disclosure.
Figure 2C:
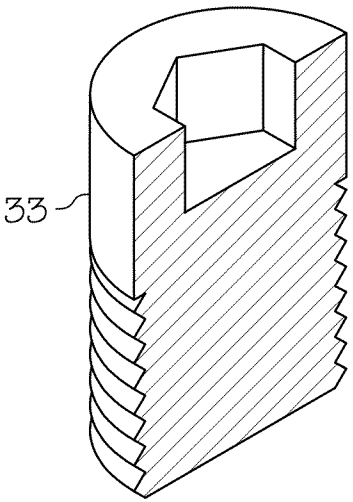
FIG. 2C shows a half sectional perspective view of a retainer pin in accordance with particular configurations of the present disclosure.
Figure 2B:
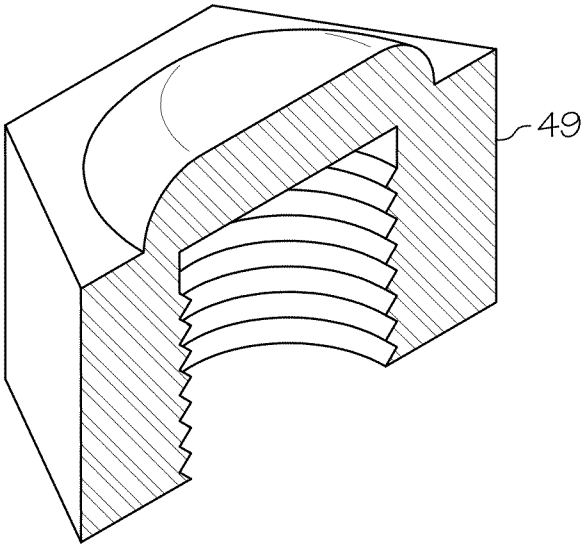
FIG. 2B shows a half sectional perspective view of an insert in accordance with particular configurations of the present disclosure.

FIGS. 2A-2C show various views of the coupling between adapter 3 and the removable tooth point 15 shown in FIG. 1. As described above, insert 49 may be positioned in a recess of adapter 3. Tooth point 15 subsequently may be positioned onto adapter 3. Thereafter, a retainer pin 33 may be coupled to each insert 49 by threading or another appropriate coupling mechanism. Insert 49 may be appropriately shaped to prevent rotation within adapter 3 when installed. For example, as shown in FIG. 2B, insert 49 may be hexagonally shaped and may include a threaded interior portion that may be configured to receive retainer pin 33. As shown in FIG. 2C, retainer pin 33 may be threaded and may include a recessed portion configured to receive a tool for threading retainer pin 33 into insert 49.

Adapter 3 may be coupled to tooth horn 2 using pin assembly 34 in a manner similar to the coupling between adapter 3 and the removable tooth point 15 shown in FIG. 2A. In particular, insert 60 may be positioned in pin bore 58, and adapter 3 subsequently may be positioned onto tooth horn 2. Thereafter, a plug 69 may be placed in each pin bore 58 and coupled to each plug bore in insert 60 by threading or another appropriate coupling mechanism. As shown in FIG. 1, insert 60 may be cylindrical; however, in certain configurations, insert 60 may be appropriately shaped to prevent rotation within tooth horn 2 when installed (e.g., hexagonally shaped similar to insert 49). Further, in certain configurations, such as those depicted in FIG. 1, insert 60 may extend across tooth horn 2 from a first side thereof to a second side thereof. Insert 60 may include a threaded interior portion that may be configured to receive a plug 69 that is similar to the threaded portion of insert 49 shown in FIG. 2B. Plug 69 may be threaded and may include a recessed portion configured to receive a tool for threading plug 69 into insert 60, each of which may be similar to the corresponding portions of retainer pin 33 shown in FIG. 2C.

Figure 3A:
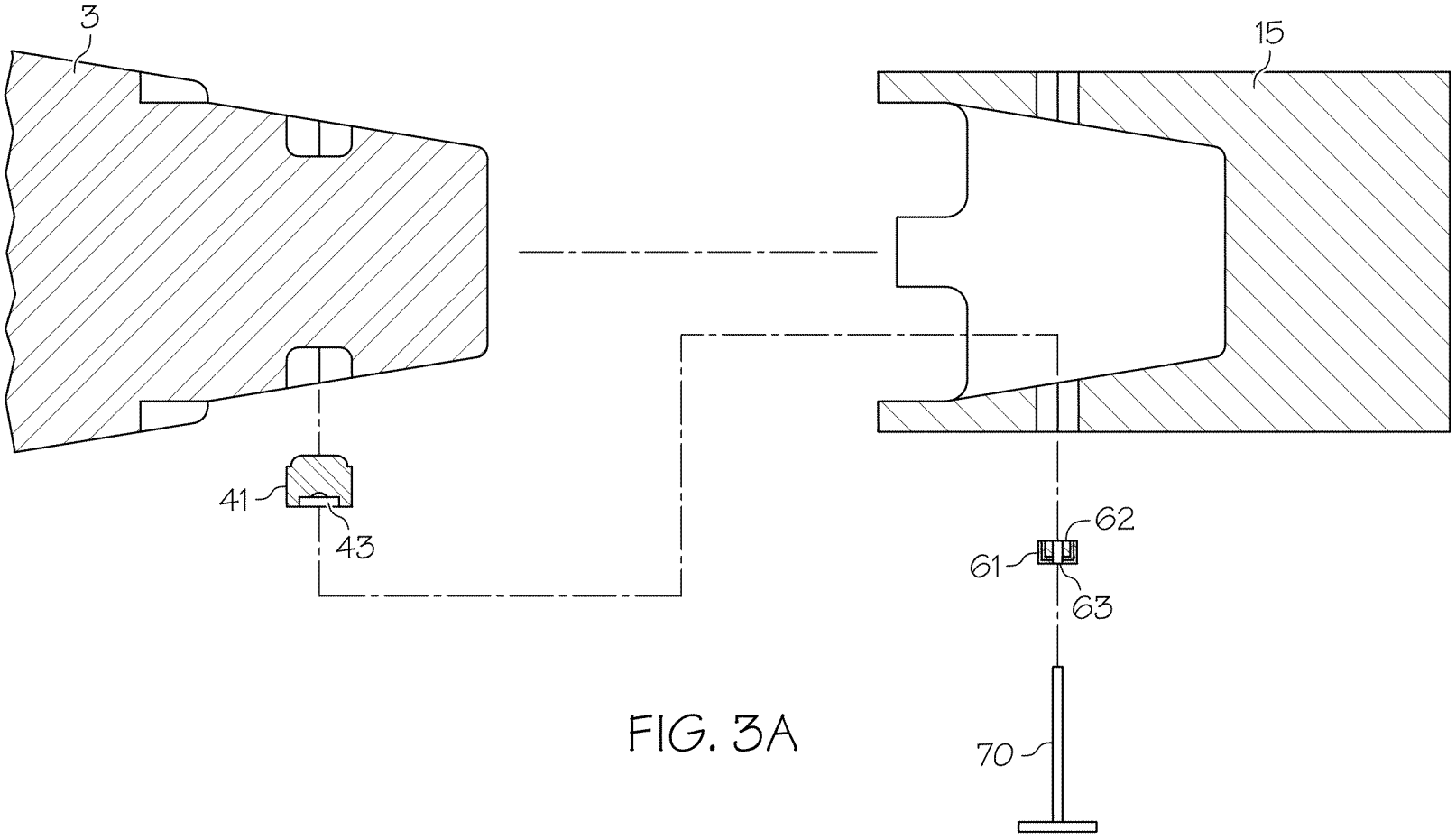
FIG. 3A shows an exploded top sectional view of another tooth assembly of an attachment system in accordance with particular configurations of the present disclosure.
Figure 3C:
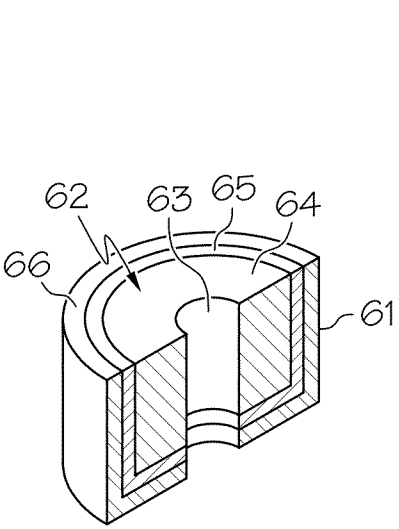
FIG. 3C shows a half sectional perspective view of a magnetic coupler in accordance with particular configurations of the present disclosure.
Figure 3B:
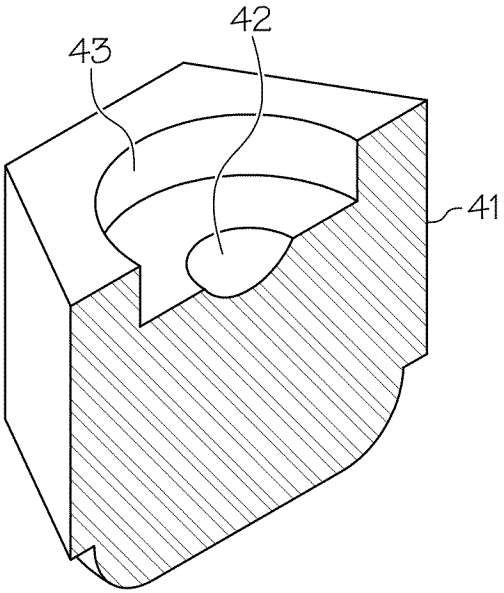
FIG. 3B shows a half sectional perspective view of an insert in accordance with particular configurations of the present disclosure.

FIGS. 3A-3C show various views of a coupling between adapter 3 and the removable tooth point 15 implementing a magnetic coupler 61 and an insert 41 in accordance with certain configurations. In certain configurations, the pairing of insert 41 and magnetic coupler 61 may be used interchangeably with the pairing insert 49 and retainer pin 33 to couple adapter 3 and the removable tooth point 15 together. Accordingly, magnetic coupler 61 may be used together with insert 41 to secure tooth point 15 to adapter 3 in lieu of a threaded retainer pin 33 and a threaded insert 49. For example, as depicted in FIG. 3A, tooth point 15 may be coupled to adapter 3 by placing insert 41 in a recess of adapter 3, positioning tooth point 15 onto adapter 3, and positioning magnetic coupler 61 onto insert 41. Magnetic coupler 61 may provide a high strength magnetic bond that may securely couple adapter 3 to tooth point 15. Magnetic coupler 61 may be placed into recess 43 that is formed in insert 41, as shown in FIG. 3B. Placing magnetic coupler 61 into recess 43 may substantially reduce or eliminate the movement or drift of magnetic coupler 61 relative to insert 41 during the operation of excavation equipment. In some configurations, recess 43 may be formed to provide 0.010 inches of clearance around a diameter of magnetic coupler 61. Alternatively, in other configurations, magnetic coupler may be of any appropriate size and may be formed to fit with any appropriate clearance of insert. In certain configurations, insert 41 may be formed with both recess 43 and a threaded portion, such that insert 41 may be configured receive either of magnetic coupler 61 or a retainer pin 33.

Adapter 3 may be coupled to tooth horn 2 using the pairing of insert 41 and magnetic coupler 61 or a combination of features thereof with insert 60 in a manner similar to the coupling between adapter 3 and the removable tooth point 15 shown in FIG. 3A. In certain configurations, insert 60 may be formed with a recess similar to recess 43 of insert 41, as shown in FIG. 3B, rather than a threaded interior portion. Accordingly, magnetic coupler 61 may be used together with insert 60 to secure adapter 3 to tooth horn 2 in lieu of a threaded plug 69 and a threaded version of insert 60. For example, similarly to the coupling between adapter 3 and the removable tooth point 15 shown in FIG. 3A, adapter 3 may be coupled to tooth horn 2 by positioning insert 60 into pin bore 58, positioning adapter 3 over tooth horn 2, and positioning magnetic coupler 61 onto the recess of insert 60. In some configurations, insert 60 may be formed with both a recess similar to recess 43 of insert 41 and a threaded portion, such that insert 60 may be configured receive either of magnetic coupler 61 or a threaded plug 69 as described above.

In particular configurations, magnetic coupler 61 may be manufactured in part from any high strength magnetic material, including, but not limited to, neodymium and samarium-cobalt magnetic materials. As shown in FIG. 3C magnetic coupler 611 may be generally cylindrically-shaped or disk-shaped with a cylindrical bore, such as bore 63, placed through the center. In alternative configurations, however, magnetic coupler 61 may be rectangular, ovular, hexagonal, or any other suitable shape, and recess 43 and the recess formed in insert 60 may be of a similar shape. Magnetic coupler 61 may include a rare earth material core 64 that may be at least partially enclosed by a shield 65. Shield 65 may be at least partially enclosed by a protective cup 66. In some configurations, shield 65 may be formed from a brass material, and protective cup 66 may be formed from a steel material. At least partially enclosing rare earth material core 64 with shield 65 and protective cup 66 may enable magnetic coupler 61 to direct the magnetic force of rare earth material core 64 in a single direction, which may be the direction projecting outwardly from a magnetic face 62 in FIGS. 3A and 3C. Additionally, protective cup 66 may protect rare earth material core 64 from chipping or breaking due to the forces placed upon rare earth material core 64 during the operation of excavating equipment. Protective cup 66 thereby protects the integrity of rare earth material core 64 of magnetic coupler 61. In some configurations, magnetic coupler 61 is formed without one or more of a shield and a protective cup to utilize the magnetic force provided by rare earth magnetic core 64 in directions other than or in addition to the direction projecting outwardly from magnetic face 62.

As shown in FIG. 3B, insert 41 may include a recess 42, which may be formed to receive a coupler guide 70 therein. Insert 60, as modified to couple with magnetic coupler 61, also may include an additional recess corresponding to recess 42 that also may be formed to receive coupler guide 70 therein. In particular configurations, coupler guide 70 may be generally T-shaped with a substantially elongated longitudinal portion and a cross-piece or disk-shaped portion attached at the base thereof. Coupler guide 70 may facilitate the rapid and safe installation of magnetic coupler 61 onto insert 41. For example, to install magnetic coupler 61 onto or within insert 41, insert 41 may be positioned in adapter 3, and tooth point 15 may be positioned onto adapter 3. Magnetic coupler 61 may be placed onto an elongated portion of coupler guide 70 through bore 63 of magnetic coupler 61 with magnetic face 62 positioned away from the cross-piece or the disk-shaped portion attached at the base of coupler guide 70 and towards adapter 3. Coupler guide 70 may be formed from a non-magnetic material to ensure that magnetic coupler 61 may not be attracted to and may not bond with coupler guide 70. Coupler guide 70 (with magnetic coupler 61 placed thereon) may be positioned in one or more of recess 42 formed in insert 41 and the corresponding recess formed in insert 60. A force subsequently may be applied to slide magnetic coupler 61 forward on coupler guide 70 until the magnetic force provided by magnetic coupler 61 secures magnetic coupler 61 to insert 41. If, for example, magnetic coupler 61 becomes attracted to or obstructed by an edge of adapter 3 during an attempted installation, coupler guide 70 may be used to shift and move magnetic coupler 61 until magnetic coupler 61 clears an obstructing edge of adapter 3 and slides into the opening of adapter 3 thereby coupling to insert 41.

In certain configurations, magnetic coupler 61 may be of sufficient length to secure adapter 3 to tooth horn 2 by contacting the sides of an opening in adapter 3 through which magnetic coupler 61 is placed. Magnetic coupler 61 thereby may prevent adapter 3 from disengaging from tooth horn 2 during the operation of excavation equipment or other replaceable machine parts. In certain configurations, magnetic coupler 61 may be of sufficient length to secure tooth point 15 to adapter 3 by contacting the sides of an opening in adapter 3 through which magnetic coupler 61 is placed. Magnetic coupler 61 thereby may prevent tooth point 15 from disengaging from adapter 3 during the operation of excavation equipment or other replaceable machine parts. Once coupled to one or more of insert 41 and insert 60, bore 63 may be filled with a bore filler material that may be formed to be the same size and width as bore 63. A bore filler material may prevent dust, rock fragments, or other abrasive material from entering magnetic coupler 61 during operation. For example, bore 63 may be filled with a neoprene cylinder that may be formed to fit into and fill the area of bore 63. In alternative configurations, one or more of insert 41 and insert 60 and respective bores therefor may be omitted and magnetic coupler 61 may couple directly with one or more of tooth horn 2 and adapter 3.

Magnetic coupler 61 may allow quick and efficient replacement of machine tool parts. For example, tooth point 15 may be coupled to adapter 3 using magnetic coupler 61, and, subsequently, tooth point 15 may be removed quickly and efficiently utilizing one or more of mechanical replacement tool 40 and a heating element 80, which is described below in more detail, as tooth point 15 degrades or wears out during use. By substantially reducing a replacement time of replaceable parts, magnetic coupler 61 may allow longer utilization of excavating equipment and other machine parts with less idle time.

Figure 4B:
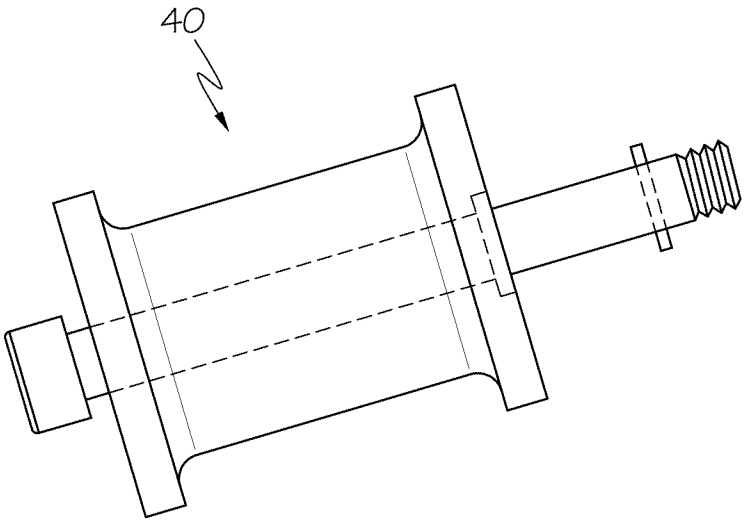
FIG. 4B shows a side view of the mechanical removal tool of FIG. 4A.
Figure 4A:
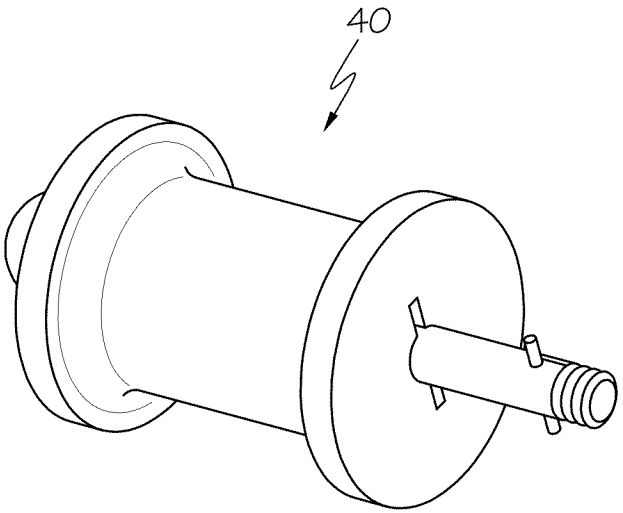
FIG. 4A shows a perspective view of a mechanical removal tool that may be utilized to remove a magnetic coupler in accordance with particular configurations of the present disclosure.
Figure 5:
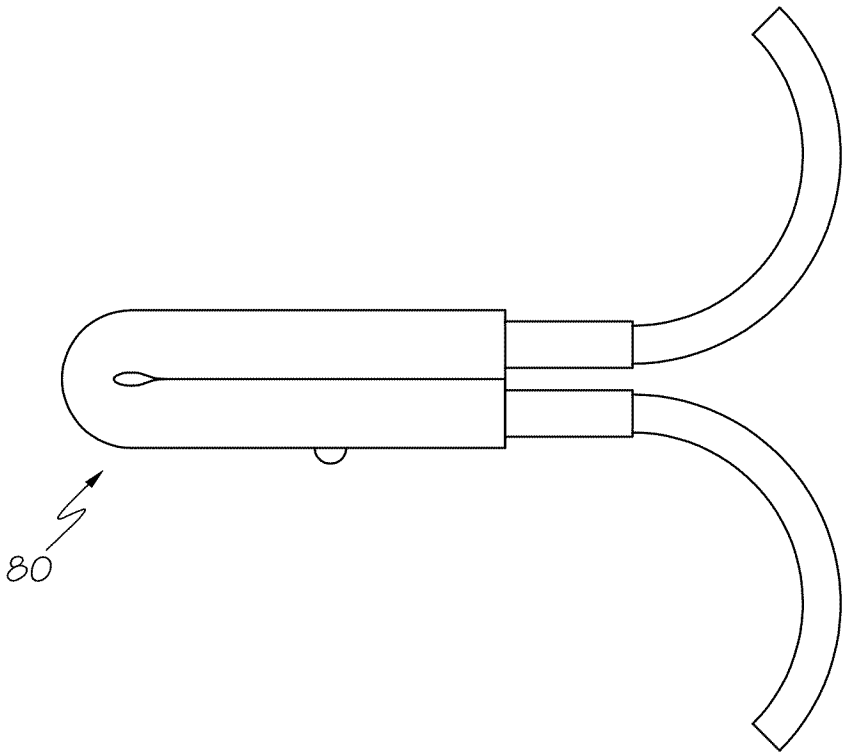
FIG. 5 shows a top view of a heating element that may be utilized to remove the magnetic coupler in accordance with particular configurations of the present disclosure.

FIGS. 4A, 4B, and 5 show various systems and methods for removing magnetic coupler 61 from one or more of insert 41 and insert 60. In some configurations, magnetic coupler 61 may be tapped or threaded from an exterior surface thereof, such that mechanical removal tool 40 may couple with magnetic coupler 61. As shown in FIGS. 4A and 4B, mechanical removal tool 40 may be threaded at an end thereof. Consequently, mechanical removal tool 40 may be threaded onto a threaded or tapped portion of magnetic coupler 61. A force may subsequently be applied to slide a portion of mechanical removal tool 40 with rapid and high-force movement against a supporting rear portion of mechanical removal tool 40, such that mechanical removal toot 40 may break the magnetic coupling of magnetic coupler 61 to one or more of insert 41 and insert 60. In some configurations, a rapid, strong force may be sufficient to break the magnetic bond created by magnetic coupler 61. Subsequently, one or more of tooth point 15 and adapter 3 may be removed and replaced, and magnetic coupler 61 may be reused or discarded.

FIG. 5 shows a heating element 80 that may be used, in some configurations, to break the magnetic bond of magnetic coupler 61. Heating element 80 may utilize standard 110 volt alternating current to create heat in excess of 500 degrees Fahrenheit. In general, however, heating element 80 may provide heat in any suitable manner and to any suitable degree. Heating element 80 may be inserted into bore 63. The heat provided by heating element 80 may serve to remove the magnetic properties of magnetic coupler 61. For example, neodymium, which may be utilized in particular configurations, may lose its magnetic properties when heated to a temperature of approximately 375 degrees Fahrenheit. Thus, heating element 80 may be used to quickly and safely remove magnetic coupler 61, such that a replacement magnetized magnetic coupler 61 may be installed.

Figure 6C:
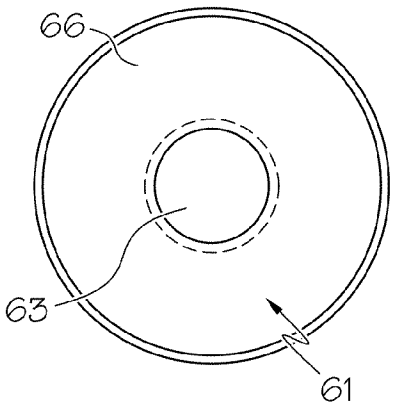
FIG. 6C shows a bottom view of the magnetic coupler of FIG. 6A.
Figure 6B:
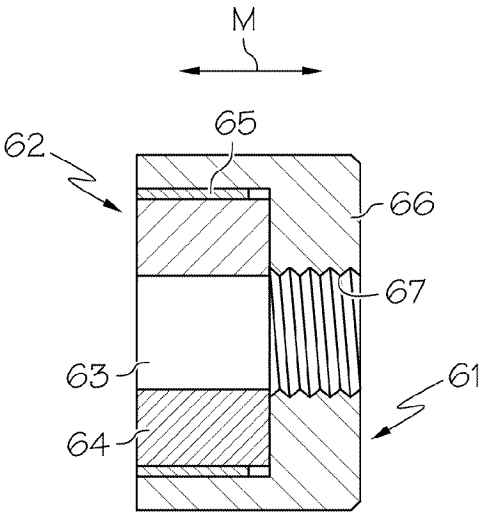
FIG. 6B shows a half sectional side view of the magnetic coupler of FIG. 6A.
Figure 6A:
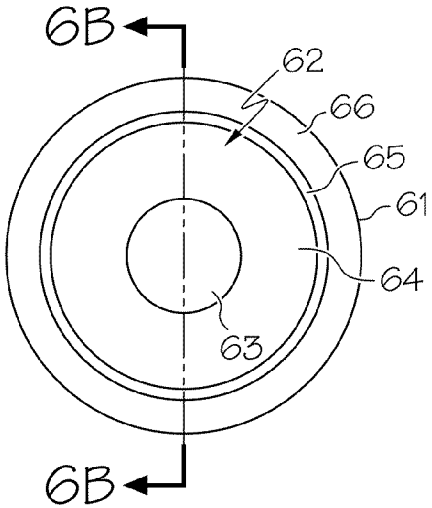
FIG. 6A shows a top view of a magnetic coupler in accordance with particular configurations of the present disclosure.

FIGS. 6A-6C show magnetic coupler 61 as described above with respect to FIGS. 3A and 3C. FIG. 6A shows a top view of a magnetic coupler 61 with magnetic face 62 facing towards the viewer. As shown in FIG. 6A, magnetic coupler 61 may include rare earth material core 64 with a cylindrical cut-out forming bore 63. Rare earth material core 64 may be at least partially enclosed by shield 65. Shield 65 may be at least partially enclosed by protective cup 66 to protect the integrity of core 64. Rare earth material core 64, shield 65, and protective cup 66, together with one or more of insert 41 and insert 60 may be referred to as a magnetic coupling assembly. FIG. 6B shows a half sectional side view of magnetic coupler 61 that shows bore 63, rare earth material core 64, shield 65, and protective cup 66. In some configurations, magnetic coupler 61 may be threaded at tap 67, which may allow magnetic coupler 61 to be coupled to mechanical removal tool 40 for removal. FIG. 6C shows a bottom view of magnetic coupler 61 with magnetic face 62 facing away from the viewer. FIG. 6C shows protective cup 66 and bore 63. In some configurations, magnetic coupler 61 may have a diameter of 2.0 inches and a length of 1.25 inches. In alternative configurations, magnetic coupler 61 may be configured to have any appropriate dimension based on the particular application and equipment magnetic coupler 61 is coupling.

In certain configurations, the position of magnetic coupler 61 and one or more of insert 41 and insert 60 may be interchangeable.

In alternative configurations, magnetic coupler 61 may be formed integrally with one or more of tooth horn 2, adapter 3, and tooth point 15. In such alternative configurations, magnetic coupler 61 may be disposed in the one or more of tooth horn 2, adapter 3, and tooth point 15 in place of one or more bores and recesses in the one or more of tooth horn 2, adapter 3, and tooth point 15.

Further, in some configurations, one or more of insert 41 and insert 60 may be formed integrally with one or more of tooth horn 2, adapter 3, and tooth point 15. In such configurations, magnetic coupler 61 may be disposed in the one or more of tooth horn 2, adapter 3, and tooth point 15 in place of one or more bores and recesses in the one or more of tooth horn 2, adapter 3, and tooth point 15.

While the invention has been described in connection with various example structures and illustrative embodiments, it will be understood by those skilled in the art that other variations and modifications of the structures, configurations, and embodiments described above may be made without departing from the scope of the invention. For example, this application comprises possible combinations of the various elements and features disclosed herein, and the particular elements and features presented in the claims and disclosed above may be combined with each other in other ways within the scope of the application, such that the application should be recognized as also directed to other embodiments comprising other possible combinations. Other structures, configurations, and embodiments consistent with the scope of the claimed invention will be apparent to those skilled in the art from a consideration of the specification or practice of the invention disclosed herein. It is intended that the specification and the described examples are illustrative with the true scope of the invention being defined by the following claims.

What is claimed is:

1. A system for coupling equipment components, the system comprising:

a tooth point;

an adapter comprising a recess formed therein; and a magnetic coupling assembly configured to couple the tooth point to the adapter, the magnetic coupling assembly configured to be received at least partially within the recess formed in the adapter, and the magnetic coupling assembly comprising:

an insert configured to be placed within the recess of the adapter, the insert comprising a first internal recess; and a magnetic coupler configured to be received within the first internal recess of the insert, the magnetic coupler comprising:

a magnetic core comprising a magnetic material; and a shield at least partially enclosing the magnetic core, the shield substantially preventing magnetic attraction between the magnetic core and the tooth point.

2. The system of claim 1, wherein the magnetic coupler comprises:

a protective cup at least partially enclosing the shield and the magnetic core.

3. The system of claim 2, wherein the magnetic coupler comprises:

a bore formed through a center thereof, and a threaded portion formed in the protective cup and substantially aligned with the bore.

4. The system of claim 3 comprising:

an apparatus for decoupling the magnetic coupler from the insert, the apparatus comprising:

an elongated portion comprising a threaded end portion, the threaded end portion configured to couple with the threaded portion of the magnetic coupler;

a sliding portion configured to slide along the elongated portion; and a supporting portion disposed at an end of the elongated portion opposite the threaded end portion, the supporting portion configured to prevent the sliding portion from separating from the elongated portion in a direction away from the magnetic coupler, wherein the apparatus is configured to decouple the magnetic coupler from the insert in response to a force applied to the sliding portion and the supporting portion in the direction away from the magnetic coupler while the threaded end portion of the elongated portion is coupled with the threaded portion of the magnetic coupler.

5. The system of claim 1, wherein the magnetic coupler comprises a bore formed through a center thereof, wherein the insert comprises a second internal recess, the second internal recess configured to be substantially aligned with the bore while the magnetic coupler is disposed within the first internal recess of the insert.

6. The system of claim 5, wherein the bore is configured to receive therethrough an elongated portion of an apparatus for installing the magnetic coupler onto the insert, wherein the second internal recess is configured to receive therein an end of the elongated portion, and wherein the magnetic coupler is configured to be substantially aligned with the first internal recess of the insert when the bore receives the elongated portion therethrough and the second internal recess receives the end of the elongated portion therein.

7. The system of claim 5 comprising an apparatus for installing the magnetic coupler onto the insert, the apparatus comprising:

an elongated portion coupled to a cross piece portion that is substantially perpendicular to the elongated portion, wherein the apparatus is configured to receive the magnetic coupler on the elongated portion via the bore of the magnetic coupler, and wherein the apparatus is configured to fit within the second internal recess of the insert.

8. The system of claim 1, wherein the recess of the adapter comprises a plurality of recess walls forming a particular shape, and wherein the insert comprises a plurality of sidewalls also forming the particular shape, such that the plurality of recess walls prevent the insert from rotating while the insert is disposed in the recess of the adapter.

9. The system of claim 1 comprising:

a tooth horn comprising a bore formed therein;

a second magnetic coupling assembly configured to couple the adapter to the tooth horn, the second magnetic coupling assembly configured to be received at least partially within the bore formed in the tooth horn, and the second magnetic coupling assembly comprising:

a second insert configured to be placed within the bore of the tooth horn, the second insert comprising a second internal recess; and a second magnetic coupler configured to be received within the second internal recess of the second insert.

10. The system of claim 9, wherein the bore of the tooth horn is formed to extend from a first side of the tooth horn to a second side of the tooth horn, wherein the second insert comprises a third internal recess, and wherein the second magnetic coupling assembly comprises a third magnetic coupler configured to be received within the third internal recess of the second insert.

11. The system of claim 9, wherein the bore of the tooth horn comprises a plurality of bore walls forming a particular shape, and wherein the second insert comprises a plurality of sidewalls also forming the particular shape, such that the plurality of bore walls prevent the second insert from rotating while the second insert is disposed in the bore of the tooth horn.

12. The system of claim 9, wherein an outermost surface of the second magnetic coupler is recessed from an outer side of the adapter by a distance between 0.125 inches and 1.000 inches.

13. The system of claim 9, wherein an outermost surface of the second magnetic coupler is recessed from an outer side of the adapter by a distance between 0.25 inches and 0.5 inches.

14. The system of claim 1, wherein the recess formed in the adapter comprises a side wall, and wherein the first internal recess of the insert is formed to provide about 0.010 inches of clearance between the side wall and the magnetic coupler.

15. The system of claim 1, wherein the magnetic coupler comprises a bore formed through a center thereof, wherein the bore is configured to be filled with a bore filler after the magnetic coupler is received within the first internal recess of the insert, and wherein the bore filler is configured to prevent abrasive material from entering the magnetic coupler.

16. The system of claim 1, wherein the magnetic coupler comprises a diameter of about 2.0 inches and a length of about 1.25 inches.

* * * * *